US011363856B2

(12) United States Patent
Gaddy

(10) Patent No.: US 11,363,856 B2
(45) Date of Patent: Jun. 21, 2022

(54) ANCHORING IMPLEMENT WITH ARROW SHAPED HOOKS

(71) Applicant: Kent Gaddy, Gravette, AR (US)

(72) Inventor: Kent Gaddy, Gravette, AR (US)

( * ) Notice: Subject to any disclaimer, the term of this patent is extended or adjusted under 35 U.S.C. 154(b) by 18 days.

(21) Appl. No.: 16/112,635

(22) Filed: Aug. 24, 2018

(65) Prior Publication Data

US 2019/0098964 A1 Apr. 4, 2019

Related U.S. Application Data

(60) Provisional application No. 62/568,310, filed on Oct. 4, 2017.

(51) Int. Cl.
*A44B 13/00* (2006.01)

(52) U.S. Cl.
CPC ..... *A44B 13/0052* (2013.01); *A44B 13/0029* (2013.01)

(58) Field of Classification Search
CPC ..... Y10T 24/1498; A44B 13/0052
See application file for complete search history.

(56) References Cited

U.S. PATENT DOCUMENTS

| | | | | |
|---|---|---|---|---|
| D370,407 | S * | 6/1996 | Pietrowski | D8/394 |
| 5,799,376 | A * | 9/1998 | Harsley | B65D 63/10 24/16 PB |
| 6,807,715 | B1 * | 10/2004 | Blair | B65D 63/1027 24/16 PB |
| 7,377,013 | B2 * | 5/2008 | Cheung | A01G 9/128 24/16 PB |
| 7,404,238 | B2 | 7/2008 | McNeill | |
| D874,905 | S * | 2/2020 | Gaddy | D8/356 |
| 2002/0170149 | A1 | 11/2002 | Severson | |
| 2005/0257348 | A1 * | 11/2005 | Byers | B65D 63/109 24/16 R |

* cited by examiner

*Primary Examiner* — Sarah B McPartlin
(74) *Attorney, Agent, or Firm* — Ariel S. Bentolila; Bay Area IP Group, LLC

(57) ABSTRACT

A device kit including a strap implement operable for strapping, wrapping, or organizing capabilities for multi-purpose needs. A plurality of strap hole portions is disposed along a length of the strap implement. A cutting section is disposed between a predetermined length of the strap implement, in which the cutting section comprises a longer distance between two strap hole portions where the two strap hole portions are spread out further, wherein the cutting section is configured to allow a strap implement to be cut into smaller pieces. An anchoring implement is configured for linking two or more strap implements through at least one of the plurality of strap holes, in which the anchoring implement comprises attachment points configured as hooks.

18 Claims, 4 Drawing Sheets

ANCHORING IMPLEMENT WITH ARROW SHAPED HOOKS

CROSS-REFERENCE TO RELATED APPLICATIONS

The present Utility patent application claims priority benefit of the U.S. provisional application for patent Ser. No. 62/568,310, entitled "The Idea/Innovation of Arrow<->Strap is the multi-linking Silicone strap design that provides users uniquely diverse strapping, wrapping, and organizing capabilities for multipurpose needs.", filed on Oct. 4, 2017 under 35 U.S.C. 119(e). The contents of this related provisional application are incorporated herein by reference for all purposes to the extent that such subject matter is not inconsistent herewith or limiting hereof.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to securing objects. More particularly, certain embodiments of the invention relate to securing objects using straps.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, an aspect of the prior art generally useful to be aware of is that there have traditionally been a few common options for fastening/securing cargo or equipment during storage or transport. One common option is a tie down strap, where the straps are commonly made of a non-stretchy, non-flexible materials such as nylon or polyester. This option may be strong enough to hold a relatively large amount of weight or strain, but since these straps lack flexibility they may damage an object being tied down. Another option is a bungee cord which is much more flexible and better for avoiding damage, but they commonly end up losing their tension integrity after too much use and are not able to withstand a range of temperatures. Furthermore, these solutions use manufacturing materials which typically do not withstand deterioration due to water damage or ultraviolet damage.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1A:
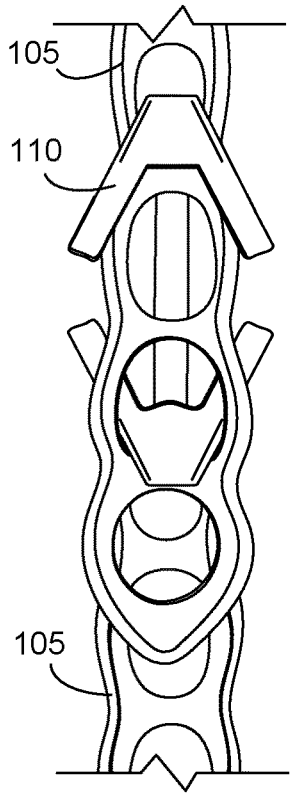
FIGS. 1A, 1B, and 1C illustrate an exemplary Arrow Strap fully assembled, where 1A illustrates a top view of a link in detail, 1B illustrates hooks being used at different angles, 1C illustrates top and side views of links, in accordance with an embodiment of the invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components is described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide an improved Arrow shaped Strap, with a multi-linking Silicone strap design which may provide strapping, wrapping, and organizing capabilities for multi-purpose needs. An exemplary Arrow shaped Strap may have a strap with multiple holes along a strap which may be linked onto at any hole using a two-sided arrow shaped hook which may then hook onto another strap. A strap may be able to stretch to two times its original length. A strap may have arrow hooks attach at any point along the strap and at any angle. The Arrow shaped Strap may have arrow hooks added or removed from a strap hole while still anchoring an object with other strap holes. Arrow shaped Straps may add strength by combining multiple straps in parallel. The Arrow shaped Strap may be made using non-metal materials, helping to avoid damage during any use of pieces including but not limited to the strap or arrow or a combination for uses including but not limited to strapping or wrapping or organizing. The strap may be made from material including but not limited to silicone. Alternatively, other materials may be used including but not limited to carbon fiber, or other fiber-based materials which may be used to improve strength for an overall strap, or a two-sided arrow material to give additional strength for larger and heavy objects such as hauling lumber or larger steel objects to a bed. An arrow shaped hook may be made from material including but not limited to nylon or other polymers for added strength. Other materials, including but not limited to metal aluminum, steel, carbon fiber, rubber based, or any fiber like material may be used to strengthen an overall ability to hold objects in place. The straps and hooks may be manufactured in a variety of colors, patterns, or glow in the dark materials. The arrow shaped straps may be corrosion proof, waterproof, and/or washable. Arrow shaped Straps may also have a non-slip grip to help keep an object in place. Straps may also be infused with a lubricating agent during a manufacturing process to improve an ability to lessen friction required to wrap, strap, or align into position of an object. Arrow shaped Straps may further be able to withstand temperatures up to 450 degrees Fahrenheit with a current silicone formula, and other elastic polymers may be chosen to increase the temperature it may withstand to protect an object from heat. An Arrow shaped Strap may be cut into smaller pieces and still be used, allowing more control of its length and strength.

Figure 1B:
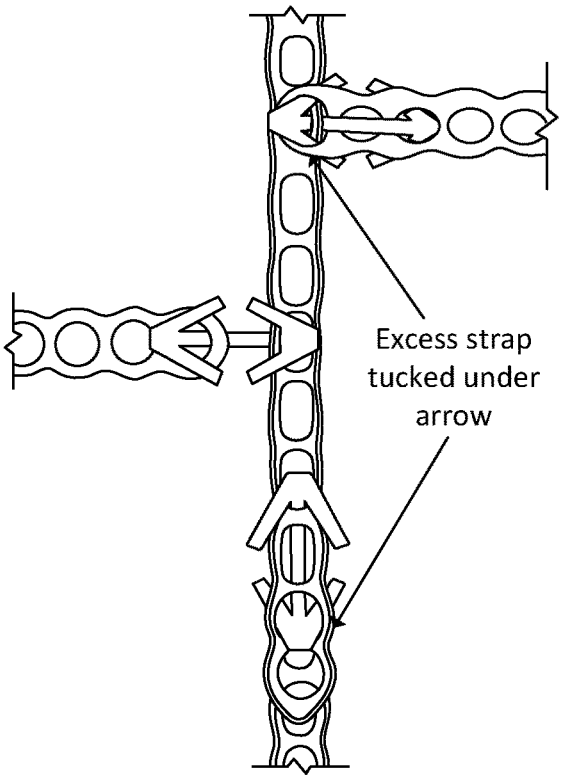
Figure 1C:
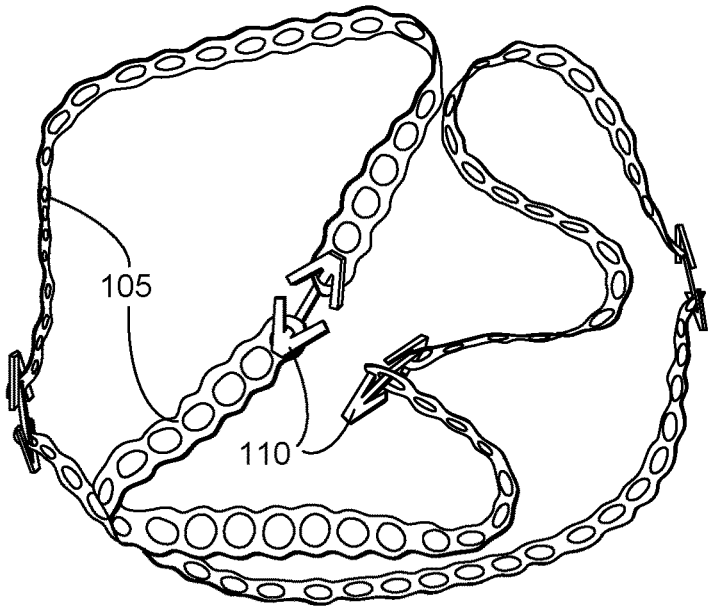

FIGS. 1A, 1B, and 1C illustrate an exemplary Arrow shaped Strap and arrow shaped hook kit assembly, where 1A illustrates a top view of a link in detail, 1B illustrates hooks being used at different angles, 1C illustrates top and side views of links, in accordance with an embodiment of the invention. FIG. 1A illustrates a strap and arrow shaped hook kit assembly where multiple straps 105, which may be linked together using an arrow shaped hook 110. FIG. 1B illustrates a strap and arrow shaped hook kit assembly where one strap 105 may have multiple hooks linking multiple additional straps together at various angles. Furthermore FIG. 1B further illustrates how excess strap 105 may be tucked under an arrow shaped hook. FIG. 1C illustrates multiple hooks 110 linking multiple straps 105 together.

Figure 2B:
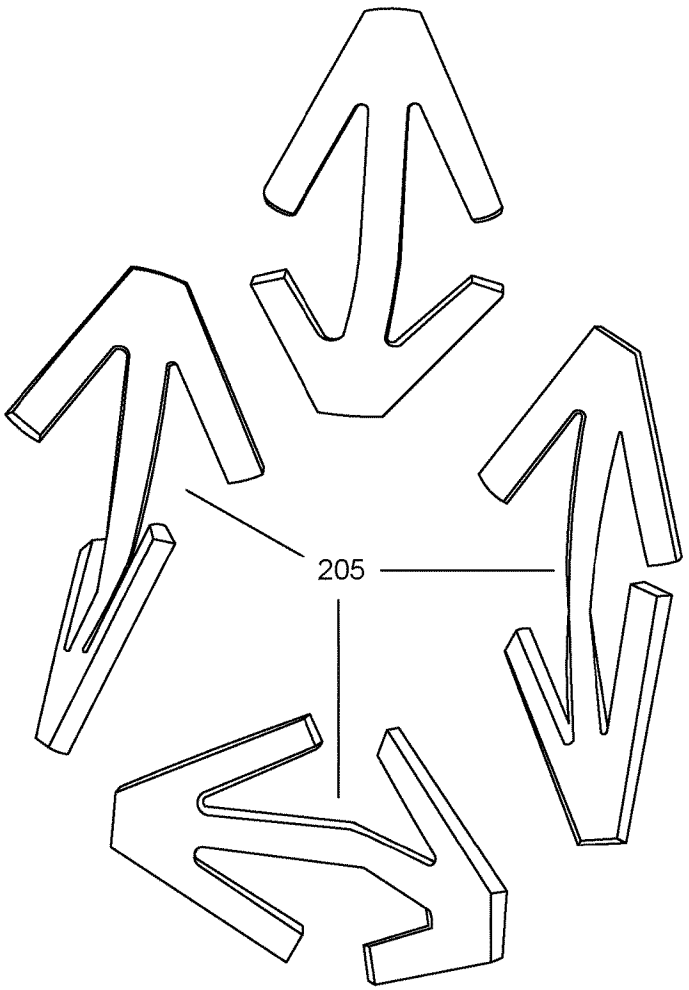
FIGS. 2A and 2B illustrate exemplary arrow hooks in detail, where 2A illustrates exemplary dimensions for an arrow hook, 2B illustrates how a flexible arrow hook may bend, in accordance with an embodiment of the invention.
Figure 2A:
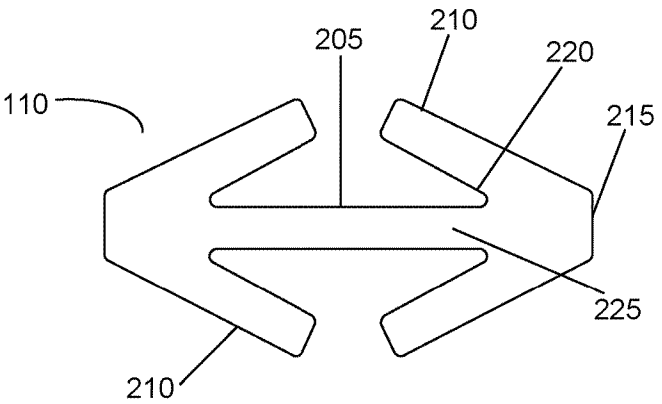
Figure 2A:
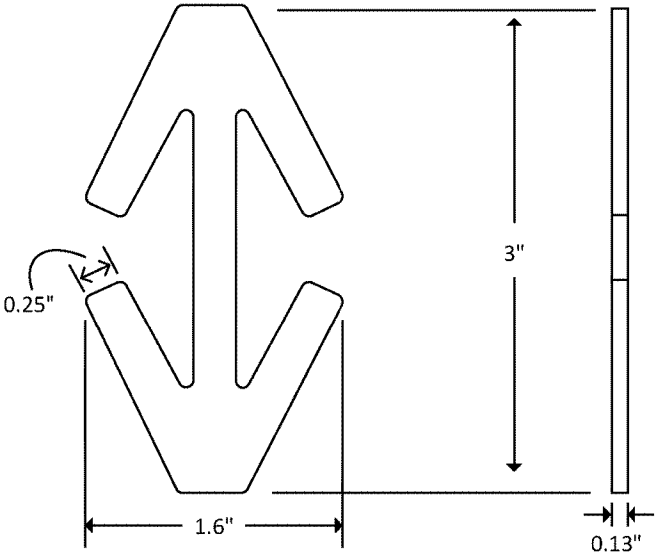

FIGS. 2A and 2B illustrate exemplary dual anchoring implement having dual arrow shaped hooks in detail, where FIG. 2A illustrates exemplary dimensions for a dual anchoring implement having dual arrow shaped hooks at each end of a connecting portion, FIG. 2B illustrates how a flexible anchoring implement having dual arrow shaped hooks 110 may bend, in accordance with an embodiment of the invention. FIG. 2A illustrates a picture of a dual anchoring implement having dual arrow shaped hooks 110 next to a drawing showing exemplary dimensions for the dual arrow shaped hooks engaged with a connecting portion, where the dimensions of a hook may vary in size and a hook may vary in shape. In an exemplary anchoring implement having dual arrow shaped hooks 110, a connecting portion 205, attachment points 210, a tip portion 215, an inner portion 220, and a notification portion 225 are shown. The connecting segment 205 has two proximate end portions which may include proximately four (4) attachment points 210 together. The attachment points 210 at each end of the connection segment 205 are configured as hooks and shaped like arrows may be used, but not limited to, engage a hole in the strap 105, allowing up to four (4) attachment points 210 in four (4) different directions to engage a strap 105 at each end of the arrow shaped hook 110. There are two attachment points 210 at each end of the connecting portion 205. Alternatively, there may only be one attachment point 210 at each end of the connecting portion 205. The additional attachment point 210 may enable an end point to attach to additional straps. The inner portion 220 may be smooth or may include grooves to create additional holding power. The tip portion 215 may be a flattened tip portion 215 and smoothen out to generally avoid damaging surrounding objects. The notification portion may be used, but not limited to, display logos, notes, numbering, instructions, etc. There may be no concept of head or tail, where the anchoring points may be symmetrical for greater use. FIG. 2B illustrates how a flexible strap anchoring implement having dual arrow shaped hooks 110 may bend around the connecting portion 205 which may help to contour to an object it is being attached to. Alternatively, a similarly useful strap anchoring implement having dual arrow shaped hooks may not have a single "V" shape at its end but may be shaped more like a three-dimensional fish hook shape which may not allow for ease of use as a flat "V" hook at its end of an arrow. Alternatively, a strap anchoring implement having dual arrow shaped hooks may use a three or four hook design on each end and not be limited to using just two hooks on each end of an arrow. Additional hook shaped designs may be curved in nature at each end of an arrow and rounded on the tip so that it may be more of a "U" shape and not a "V" shape. Pieces may be manufactured to have shapes including but not limited to grooves like a saw blade (zig zag) either on an inside surface 220 of each hook or on an outer side of each hook to create additional holding power of a hook design. This may include no zig zag on hook as shown in FIG. 2A & FIG. 2B but not limited to only zig-zag inside, or only zig-zag on an outside of a hook or a combination of both.

Figure 3A:
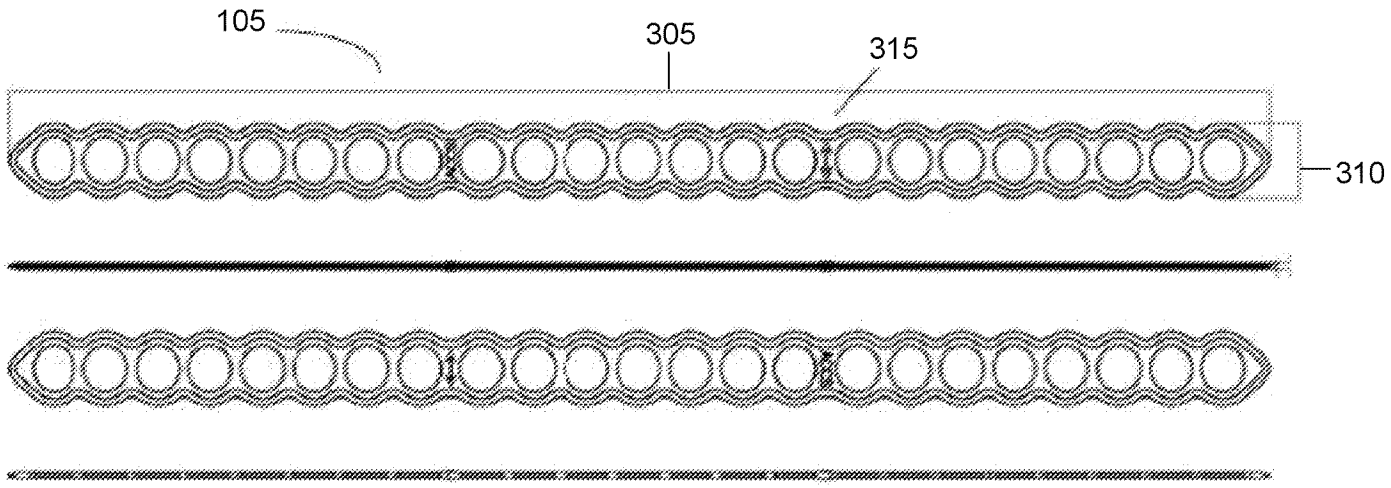
FIGS. 3A, 3B, and 3C illustrate exemplary straps, where 3A illustrates a drawing showing exemplary straps and their exemplary dimensions, 3B illustrates a picture of an exemplary strap, 3C illustrates a zoomed in detailed view for a strap, in accordance with an embodiment of the invention.
Figure 3B:
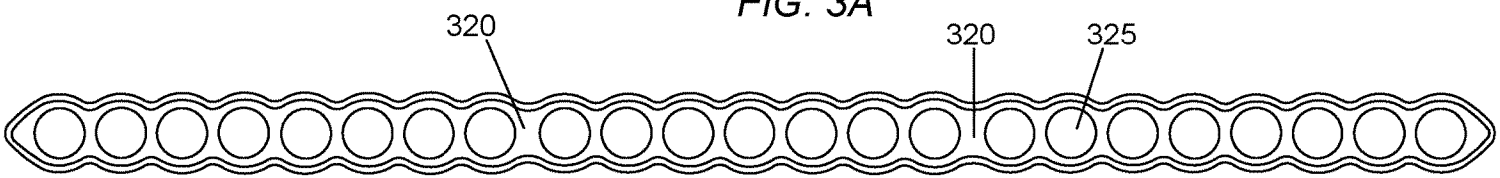
Figure 3C:
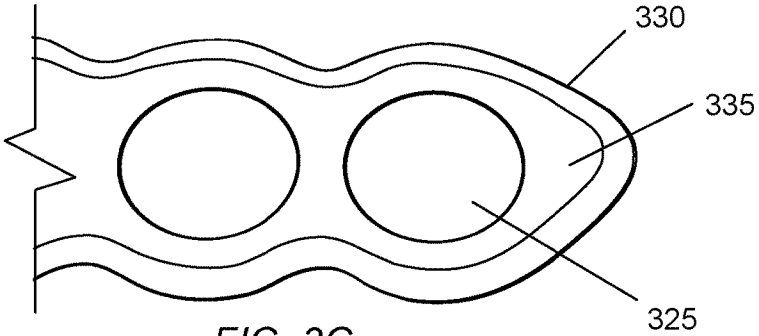

FIGS. 3A, 3B, and 3C illustrate exemplary straps, where 3A illustrates a drawing showing exemplary straps and their exemplary dimensions, 3B illustrates a picture of an exemplary strap, 3C illustrates a zoomed in detailed view for a strap, in accordance with an embodiment of the invention. FIG. 3A illustrates top and side views of straps 105 with exemplary dimensions length 305, width 310 and height 315 which may include but are not limited to 24 inches length, 1.3 inches width, 0.05 inches and 0.10 inches thickness, and 0.75 inches diameter. A wide variety of dimensions/materials used may further help users meet various needs. FIG. 3B illustrates a picture of an exemplary strap 105. The straps 105 may have a cutting section 320 where strap holes 325 are spread out further, to allow a user to cut a strap 105 into smaller pieces. The cutting section 320 may include a wider spacing between the holes to provide an allowance between holes for cutting. FIG. 3C illustrates a zoomed in detailed view of a strap 105 and a strap's tip 330 showing an arrow shaped tip and how a strap 105 may be thicker around the hook support area 335 of the hole 320 where a hook may be linked, in order to resist tearing. The hook support area 335 is an area around the perimeter of the hole that is thicker to resist tearing. A strap's holes 320 may vary in shape including but not limited to round, oblong, square, rectangle, triangle, honeycomb, five (5) or more sided polygon, etc. In consideration for a hole shape design of holes and sizes based on dimensions from FIG. 3A this may allow inner weaving of multiple straps together to add to additional uses without hooks or it may allow for excess to be tucked into another strap or into itself. In an exemplary embodiment, an object may be inserted to block an adjacent strap from pulling apart without use of a hook. A metal bar (with varying lengths) may block holes in a strap thus this may not allow them to be separated. Alternative cosmetics or varying sizes or colors of pieces may create visual effects useful for displaying it. In an exemplary embodiment it may display a "metal bar" for someone to see without touching a metal bar. Also, another exemplary embodiment comprising holes based on the shape and dimensions illustrated by way of examelt in FIG. 3A may allow objects of varying sizes to be inserted into the holes to be held in place or inserted into the holes for organzation by hanging the strap vertically. Examples of this may include without limitation duck calls, soda bottle necks, mace bottles, eye glasses, small hotel sized shampoo bottles, etc.

Figure 4:
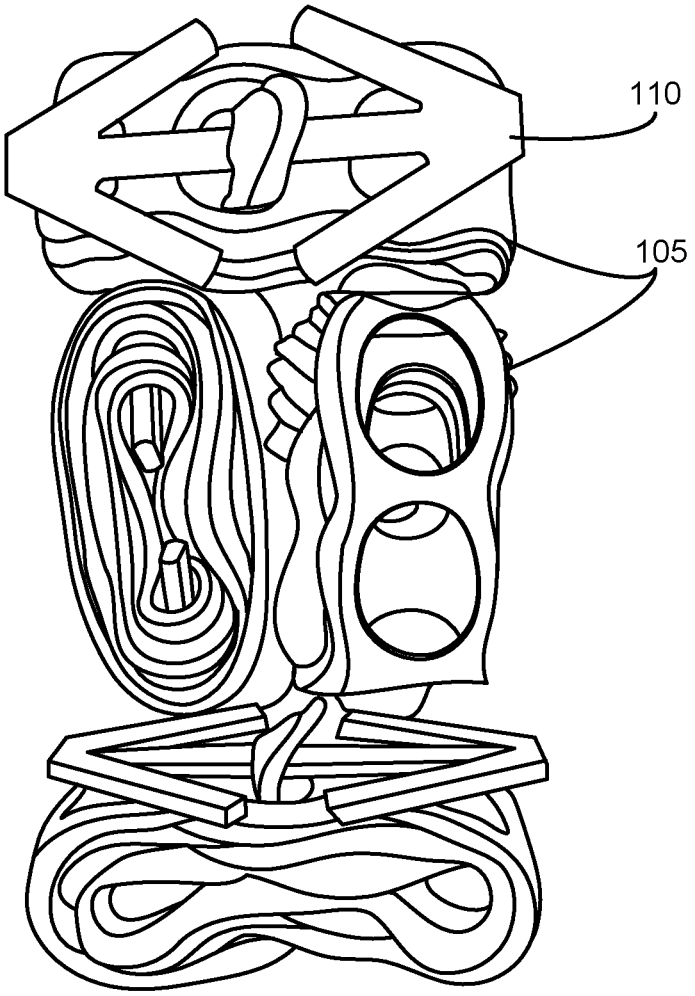
FIG. 4 illustrates how exemplary straps and arrow hooks may be stored, in accordance with an embodiment of the invention.

FIG. 4 illustrates how exemplary straps and arrow hooks may be stored, in accordance with an embodiment of the invention. FIG. 4 illustrates how straps 105 and anchoring implement having dual arrow shaped hooks 105 maybe stored relatively neatly, needing only a relatively small space for storage.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing object securing according to the present invention will be apparent to those skilled in the art. Various aspects of the invention have been described above by way of illustration, and the specific embodiments disclosed are not intended to limit the invention to the particular forms disclosed. The particular implementation of the object securing may vary depending upon the particular context or application. By way of example, and not limitation, the object securing described in the foregoing were principally directed to object securing using straps implementations; however, similar techniques may instead be applied to securing objects in similar hooking methods not using straps, or securing objects to make up a single piece such as furniture parts, or an arrow with its nylon properties or other non-heat conducting materials or properties could be used to pick up Hot (450—oven) or Very cold (−450 F—Dry Ice) items with its "V" shape at each end (as illustrated in FIG. 2A), or have a "U" shape on each end, or could have double "U" (fish hook example) with a longer shank to pick out boiling objects that are submersed, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising:

a strap implement, wherein said strap implement is configured to be operable for strapping, wrapping, holding, or organizing objects or things, in which said strap implement comprises;

a plurality of strap hole portions disposed along a length of said strap implement;

a cutting section, in which said cutting section comprises a longer distance between at least two strap hole portions, where said two strap hole portions are spread out further, wherein said cutting section is configured to allow said strap implement to be cut into smaller pieces;

a first arrow-shaped strap tip disposed at a proximate end of said strap implement;

a first arrow-shaped strap tip hole disposed at said proximate end of said strap implement;

a second arrow-shaped strap tip disposed at another proximate end of said strap implement;

a second arrow-shaped strap tip hole disposed at said another proximate end of said strap implement;

a first hook support area, wherein said first hook support area comprises a thicker area around a perimeter of said first arrow-shape strap tip hole to resist tearing; and a second hook support area, wherein said second hook support area comprises a thicker area around a perimeter of said second strap tip hole to resist tearing;

an anchoring implement, wherein said anchoring implement is separate from said strap implement, and wherein said anchoring implement is not attached to said strap implement, in which said anchoring implement comprises:

a first anchoring tip segment;

a first attachment point, wherein said first attachment point comprise a first single hook that is configured to be operable for engaging at least one of said plurality of strap hole portions disposed along said strap implement;

a first inner portion, wherein said first inner portion is configured to be operable for creating additional holding power in said first attachment point;

a second anchoring tip segment;

a second attachment point, wherein said second attachment point comprise a second single hook that is configured to be operable for engaging at least one of said plurality of strap hole portions disposed along said strap implement;

a second inner portion, wherein said second inner portion is configured to be operable for creating additional holding power to said second attachment point; and a connecting portion, wherein said connecting portion comprise a solid connecting portion with no holes that is configured to be flexible and operable to contour to an object it is attached to, and wherein said connecting portion forms a bridge between said first attachment point and said second attachment; and wherein said anchoring implement is not a part of said strap implement;

a first hook-shaped anchoring implement formed by said first anchoring tip segment, said first single hook, and said first inner portion;

a second hook-shaped anchoring implement formed by said second anchoring tip segment, second single hook, and said second inner portion; and wherein said strap implement is not a part of said anchoring implement.

2. The device of claim 1, in which said first attachment point comprises an additional hook having an inner portion to form a first V-shaped anchoring implement.

3. The device of claim 2, in which said second attachment point comprises an additional hook having an inner portion to form a second V-shaped anchoring implement.

4. The device of claim 3, in which said plurality of strap holes are periodically spaced along a portion of said strap implement.

5. The device of claim 4, in which each of said plurality of strap hole portions are configured to be operable for receiving at least one of said first hook-shaped anchoring implement and second hook-shaped anchoring implement.

6. The device of claim 5, wherein said first inner portion comprises at least a smooth edge or grooved edge that is configured to create additional holding power.

7. The device of claim 4, in which said plurality of strap holes comprises a plurality of honeycomb shaped holes periodically spaced along a portion of said strap implement, wherein a perimeter of each of said plurality of honeycomb shaped holes is thicker to resist tearing.

8. The device of claim 1, in which said plurality of strap holes are periodically spaced along a portion of said strap implement.

9. The device of claim 8, in which said anchoring implement further comprises a notification portion, wherein said notification portion is configured to display at least one of, a logo, a note, a numbering, and an instruction.

10. A device kit comprising:

a strap implement, wherein said strap implement is a flexible strap implement that is configured for multipurpose needs including strapping, wrapping, holding or organizing objects or things;

a plurality of strap hole portions disposed along said strap implement;

a cutting section, in which said cutting section comprises a longer distance between two strap hole portions where said two strap hole portions are spread out further, wherein said cutting section is configured to allow a strap implement to be cut into smaller pieces;

a hook support area, wherein said hook support area comprise a thicker area around a perimeter of each of said plurality of strap hole portions to resist tearing;

an anchoring implement, in which said anchoring implement comprises a separate or detached anchoring implement, said anchoring implement further comprises:

a first end portion having a first tip segment and two attachment points, wherein each of said two attachment points comprise a hook;

a second end portion having a second tip segment and two attachment points, wherein each of said two attachment points comprise a hook;

a solid connecting segment with no holes, wherein said connecting segment connects said first end portion and said second end portion; and wherein said anchoring implement is not a part of said strap implement; and wherein said anchoring implement is configured to be operable for linking two or more strap implements through at least one of said plurality of strap holes; and in which said first end portion comprises a first V shaped anchoring implement and said second end portion comprises a second V shaped anchoring implement.

11. The device of claim 10, in which said plurality of strap holes are periodically spaced along a portion of said strap implement.

12. The device of claim 11, in which said first end portion comprises a generally V shaped end portion.

13. The device of claim 12, in which said second end portion comprises V shaped end portion.

14. The device of claim 13, in which said two attachment points of said first end portion further comprises an inner portion, wherein said inner portion comprises at least a smooth edge or grooved edge that is configured to create additional holding power.

15. The device of claim 10, in which said two attachment points of said first and second end portion further comprises an additional hook, wherein said additional hook forms a fish hook shape first and second end portion.

16. The device of claim 15, in which said anchoring implement further comprises a notification portion, wherein said notification portion is configured to display at least one of, a logo, a note, a numbering, and an instruction.

17. The device of claim 10, in which said anchoring implement having said V shaped attachment points being disposed at said first end and second end portions is independent from, uncoupled from, or separate from said strap implement.

18. The device of claim 17, in which said plurality of strap hole portions comprises a plurality of honeycomb shaped hole.

* * * * *